United States Patent [19]

Prost

[11] Patent Number: 4,846,746

[45] Date of Patent: Jul. 11, 1989

[54] METHOD FOR THE MANUFACTURE OF VACUUM TUBES STEMS

[75] Inventor: Alain Prost, Villeurbanne, France

[73] Assignee: Videocolor, Montrouge, France

[21] Appl. No.: 125,243

[22] Filed: Nov. 25, 1987

[30] Foreign Application Priority Data

Nov. 28, 1986 [FR] France ..... 86 16668

[51] Int. Cl.[4] ..... H01J 9/00

[52] U.S. Cl. ..... 445/22; 65/55

[58] Field of Search ..... 445/22, 23, 26, 27, 445/29, 33, 44; 65/54, 55

[56] References Cited

U.S. PATENT DOCUMENTS

| | | | |
|---|---|---|---|
| 2,030,185 | 2/1936 | Rose | 65/54 |
| 2,318,652 | 5/1943 | Wiener | 65/55 |
| 2,342,609 | 2/1944 | Ellefson . | |
| 2,345,278 | 3/1944 | Monack | 65/55 |
| 2,374,269 | 4/1945 | Breadner et al. . | |
| 2,497,545 | 2/1950 | Greiner | 65/54 |
| 2,671,291 | 3/1954 | Daley | 65/55 |
| 2,817,927 | 12/1957 | Cowley | 65/55 |
| 3,477,835 | 11/1969 | Brill et al. . | |

*Primary Examiner*—Kurt Rowan

*Attorney, Agent, or Firm*—Oblon, Spivak, McClelland, Maier & Neustadt

[57] ABSTRACT

A method of manufacturing stems for vacuum tubes is disclosed. The method makes it possible, in particular, to improve the quality of the seal between the metallic bushings and the glass of the stem. The method consists in loading a bottom mold with a first glass piece and a second glass piece and metallic conductors, and then in heating the glass pieces before pressing them against each other between the bottom mold and the top mold. According to one characteristic of the invention, the first piece, which constitutes an external piece partially fixed in the bottom mold, is directly heated only on an upper part which is not fixed, and the two glass pieces are pressed against each other as soon as the upper part has reached a so-called working temperature in order to prevent prolonged contact between the upper part and a limited surface of the conductors.

9 Claims, 2 Drawing Sheets

METHOD FOR THE MANUFACTURE OF VACUUM TUBES STEMS

BACKGROUND OF THE INVENTION

1. Field of the Invention

The invention pertains to a method for the manufacture of stems for vacuum tubes making it possible, in particular, to improve the quality of the seal between metallic bushings and the glass of the stem. The invention also pertains to a stem obtained by the method of the invention.

2. Description of the Prior Art

The proper functioning and longevity of a vacuum tube, for example a cathode tube, are related to the preservation of the vacuum made in the tube and, consequently, are related to the quality of the imperviousness of the metallic bushings which electrically connect the inside of the tube to its outside through a glass stem.

The imperviousness of the bushing or bushings depends on the quality of the metal-glass bond, the bond being due to the dissolving, in the glass, of the metallic oxide formed on the surface of the metal or the conductor used to make the bushing.

Generally, the metallic bushing is made with a metallic wire (ferro-nickel lined with copper for example), and it is the dissolving of copper oxide in glass which is liquid or almost liquid that gives a precise wetting of the glass on the copper of the conductor. This dissolving or diffusion of metal oxide takes place all the more efficiently as the temperature of the glass is higher.

For series manufacture, the stems are usually made on an indexing table type transfer machine that has a number of molds set at the edge of the table. The rotation of the table makes the molds go past several different positions where they undergo an operation before going on to a following position. These operations are, for example, loading, pre-heating, molding, etc. The mold comprises a hollow mold (called the bottom mold) with a certain number of bores intended to receive conductors set in a circle. The bottom mold is loaded with the conductors and then loaded with cylindrical glass pieces one of which is placed inside the laying-out circle and the other outside it. The set is then heated, generally by means of burners, firstly in order to provoke the appropriate reaction at the surface of the conducting metal to make the said metal oxidize and, secondly, to carry the glass pieces, in a substantially uniform way, to a temperature known as a working temperature which is close to the melting temperature.

The metallic conductors are then embedded in molten glass by pressing the glass pieces between the bottom mold and a top mold. The result of this process, after cooling, is a pre-formed stem. This preliminary stem is then re-heated and re-molded to obtain a final part with a given geometry.

It is observed that a considerable number of stems made in this way have imperviousness defects at the metallic bushings, and the author of the present invention attributes these defects to a lack of homogeneity in the layer, a lack by which the metal oxide is formed around and on the embedded length of conducting metal. For, since the quality of the glass-metal bond is related to the dissolving in the liquid glass of the metallic oxide that has formed on the surface of the conductor, when the oxide dissolves incompletely, there remains a more or less crumbly oxide interface on the surface of the metal between the glass and the metal, and the crumbly oxide interface is capable of breaking under the effect of mechanical or thermal stresses. The solidity of the glass-metal bond then depends on the thickness of the oxide layer.

OBJECT OF THE INVENTION

It is an object of the present invention to enable the inclusion of metal in glass with a residual layer of metal oxide that is very small or even non-existent.

SUMMARY OF THE INVENTION

The foregoing object is obtained, in the process of the invention, notably by avoiding any prolonged contact, before the pressing stage, between a limited part of the conductor surface to be embedded and either of the glass pieces.

According to the invention, a method for the manufacture of vacuum tube stems comprises the loading of a bottom mold of a known type with at least one metallic conductor and with a first glass piece and a second glass piece, placed on either side of the conductor. The first glass piece is partially fixed in the bottom mold and forms an external piece which surrounds the conductor and the second piece. The method then consists in the heating of the glass pieces and the conductor or conductors, and then in the pressing of the glass pieces against each another between the bottom mold and a top mold to obtain a preformed stem in which the conductor is enclosed. For the heating of at least the first glass piece, only an upper part of the first glass piece is exposed to the heat produced by a heat generator. The two glass pieces are pressed against each other as soon as the upper part directly exposed to heat reaches a so-called working temperature, so as to prevent prolonged contact, before the pressing operation, between the metallic conductor and the glass pieces.

BRIEF DESCRIPTION OF THE DRAWINGS

The invention will be better understood from the following description, given as a non-exhaustive example, and the four appended figures.

DETAILED DESCRIPTION OF THE INVENTION

Figure 1:
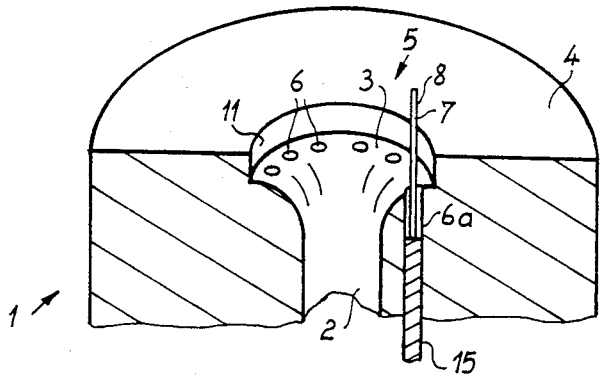
FIG. 1 is a partial cutaway, in perspective, of a bottom mold used to make a preformed stem according to the method of the invention.

FIG. 1 shows the hollow part of a mold, the hollow part being called a bottom mold. The bottom mold 1 is of a conventional type and has an axial opening 2 with a flared outlet 3 on the side of an upper face 4 of the bottom mold 1. The flared outlet 3 is extended by a wall 11 of a circular, second opening 5 made in the upper surface 4.

A series of holes 6 is made in the flared outlet 3 along axes (not shown), which are substantially equidistant and parallel to the axial opening 2, and the holes 6 are arranged in a circle. The holes 6 are designed to take metallic conductors such as the metallic conductor 7, which is the only one shown in one of these holes shown in a sectional view and marked *6a*. When the mold 1 is being loaded, the metallic conductors 7 are inserted in the holes 6 so that their upper end 8 extends beyond the upper surface 4 of the bottom mold 1. Each of the metallic conductors 7 is carried in a conventional way by a support 15 which is partially engaged in a corresponding hole 6. The metallic conductors 7 are designed for inclusion in glass to form metallic bushings. In the non-exhaustive example described, the metallic conductors 7 are of the ferro-nickel type coated with copper.

Figure 2:
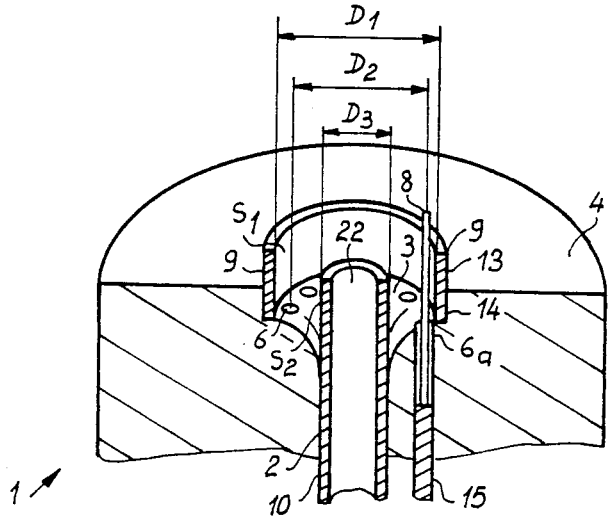
FIG. 2 is a partial cutaway, in perspective, of the bottom mold loaded with glass pieces and a metallic conductor.

FIG. 2 shows the bottom mold 1 after a loading operation in which the bottom mold 1 has been loaded with the metallic conductors 7 (only one conductor is shown for the clarity of the figure) and with a first glass piece and a second glass piece, 10.

In the non-exhaustive example of the description, the glass pieces 9, 10 have a hollow, circular, cylindrical shape. The first glass piece 9 has a first internal diameter D1 which is greater than a second diameter D2 of the circle along which are set the holes 6 containing the metallic conductors 7. The second diameter D2 is itself greater than a third external diameter D3 of the second glass piece 10. The first glass piece 9 is set outside the holes 6, through which the metallic conductors 7 pass in such a way that that they are substantially centered around the axial opening 2 and lie on the flared outlet 3, so that the first glass piece 9 has an upper part 13 which goes beyond the upper surface 4 and a bottom part 14 which is fixed in the bottom mold 1. Since the second piece 10 is engaged in the axial opening 2, it is set inside the circle formed by the holes 6 designed for the passage of the metallic conductors 7. The second piece 10 has an upper part 22 which goes over the flared outlet 3, so that the first and second glass pieces 9, 10 have surfaces S1, S2 which face each other.

Figure 3:
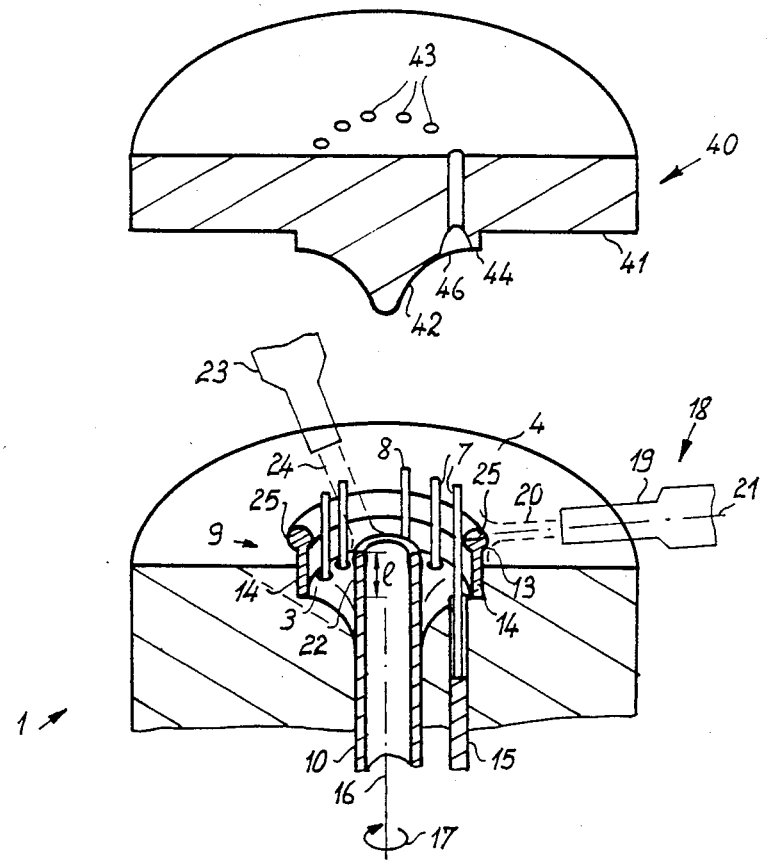
FIG. 3 is a partial cutaway, in perspective, of a top mold as well as the bottom mold loaded with glass pieces and the metallic wire, illustrating a stage in the method of the invention wherein the glass pieces are heated before being pressed against each other.

FIG. 3 illustrates a stage in the method of the invention wherein the glass pieces 9, 10 and the metallic conductors 7 are heated in one or more stages In the non-exhaustive example described, since the bottom mold 1 is mounted, in a manner known per se, on a table (not shown), it rotates on itself on an axis of symmetry 16 forming the axis of the axial opening 2 in the direction shown, for example, by an arrow 17.

During the rotation of the bottom mold 1, the first glass piece 9 is heated by one or more heat generators 18. Only one heat generator 18 is shown for this purpose in FIG. 3 for the greater clarity of the figure. In the non-exhaustive example described, the heat generator 18 comprises a conventional burner 19 which creates a flame 20 to which the first glass piece 9 is exposed. The burner 19 is pointed along a heating axis 21 which is substantially parallel to the plane of the upper surface 4 of the bottom mold 1 so that, according to one characteristic of the invention, only the upper part 13 of the first glass piece 9 is exposed to the flame 20.

The second glass piece 10 is heated by a second burner 23, for example, which produces a flame 24. The second burner 23 is placed above the bottom mold 1. It is tilted with respect to the upper surface 4 and pointed so that it heats the upper part 22 of the second glass piece 10. The metallic conductors 7 are also exposed to the heat produced by the second burner 23, but they are exposed for a relatively short time, at each rotation of the bottom mold 1. As a result, the metallic conductors 7 reach temperatures that are lower than those of the first and second glass pieces 9, 10, but which are nonetheless sufficient to cause the formation of a layer of metal oxide (not shown) consisting of copper oxide in the non-exhaustive example described.

In the non-exhaustive example described, the upper part 22 of the second glass piece 10 is heated in a substantially uniform manner throughout its length 1, which should take part in the embedding of the metallic conductors 7. However, the first glass piece 9 is not exposed directly to the heat produced by the burner 19 except at its upper part 13 the first glass piece 19 is not uniformly heated and its bottom part 14 is taken to a lower temperature than its upper part 13. When the upper part 13 reaches the so-called working temperature, corresponding substantially to the melting temperature of glass, the upper part 13 tends to subside on itself owing to the softening of the glass, so the upper part 13 loses its height above the upper face 4 and has excess thicknesses 25, as compared with its original shape, the excess thicknesses 25 coming into contact with the metallic conductors 7. The metallic conductors 7 are then partially coated with glass. This means that their surface pointed towards the first glass piece 9 is in contact with the first glass piece 9 and is stuck to the first glass piece 9, whereas their opposite surface, pointed inwards, is still in the open air.

In the prior art, the bonding of the metallic conductor or conductors 7 to the first glass piece 9 is turned to advantage to lift the first glass piece 9 by pushing, for example, on the supports 15 so as to release the bottom part 14 of the first glass piece 9 from the bottom mold 1. The bottom part 14 is then directly heated in turn so that it is also taken to a temperature close to the working temperature. The advantage of this prior art method is that the entire external piece is taken to the working temperature, which is the temperature at which the glass is really self-bonded. As a result of this, in the operation where the external piece is pressed against the internal piece to embed the conductors, the glass of these two pieces is bonded together appropriately and equally at every point. However, the major disadvantage of this method of the prior art lies in the fact that, when a metallic conductor is in contact with glass at high temperature, the temperature of the metallic conductor also rises and this considerably stimulates the formation of metal oxide on the unoccupied surface of the metallic conductor. This formation of metal oxide on the unoccupied surface is stopped only with the complete embedding of the metallic conductor, namely, when the two glass pieces are pressed against each other. The result of this is that the metal oxide layer is far greater on that conductor surface which is embedded last, and the metal oxide layer may be so thick that it only partially dissolves in the molten glass, leaving, between the glass and the metal, a crumbly layer which destroys the quality of the glass-metal bond.

With the method of the invention, this defect is avoided by the fact that the metallic conductor or conductors 7 are entirely embedded in the glass because the first glass piece 9 and the second piece 10 are pressed to each other as soon as the upper part 13 of the first glass piece 9 reaches the working temperature or very shortly after this instant i.e., substantially when the upper part 13 subsides on itself and comes into contact with the conductors 7.

Since the bottom part 14 of the first glass piece 9 is not heated directly, it is chiefly by conduction that its temperature rises. Hence, the method of the invention lies in adjusting the heat flux produced by the burner 19 and received by the upper part 13 of the first glass piece 9 so that the bottom part 14 of the first glass piece 9 reaches or goes beyond the softening temperature when the upper part 13 reaches the working temperature. The softening temperature is a temperature of about 630° C. to 650° C., at which glass becomes sufficiently malleable for its shape to be changed by mechanical action.

Hence, when the upper part 13 reaches the working temperature, the inclusion of the metallic conductor or conductors 7 is done immediately by pressing the two glass pieces 9, 10 against each other, the metallic conductors 7 being placed between the two glass pieces 9, 10.

The two glass pieces 9, 10 are pressed against each other by means of a mold, called a top mold 40, of a type known per se. The top mold 40 has the general shape of a disk with a lower surface 41 pointed towards the bottom mold 1. The lower surface 41 has a protuberance 42 at its center which is substantially complementary to the flared outlet 3. The top mold 40 has a second series of holes 43, drilled in a peripheral part 44 of the protuberance 42 as shown in FIG. 3. The second series of holes 43 is intended for the passage of the non-embedded upper end 8 of the metallic conductors 7. In the non-exhaustive example described, an end 46 of each one of the second series of holes 43 is located on the side of the protuberance 42. Each end 46 is formed by a flared portion to allow the formation of a glass ball through which the length of the inclusion in glass of the metallic conductor 7 is increased.

The pressing operation using the bottom mold 1 and the top mold 40 is a conventional operation performed by bringing the top and bottom molds 40, 1, closer together, until they are applied to each other by their upper and lower surfaces 4, 41 respectively. Under the effect of the pressing action, the upper part 22 of the second glass piece 10 tends to flare out until it is applied against the first glass piece 9. The first glass piece 9 is pushed at the same time against the flared outlet 3 by the peripheral part 44 of the top mold 40 in a manner known per se (not shown in FIG. 3). The metallic conductors 7 are engaged at the same time in the second series of holes 43 so that they are totally embedded at their part located between the second series of holes 43 and the flared outlet 3.

Figure 4:
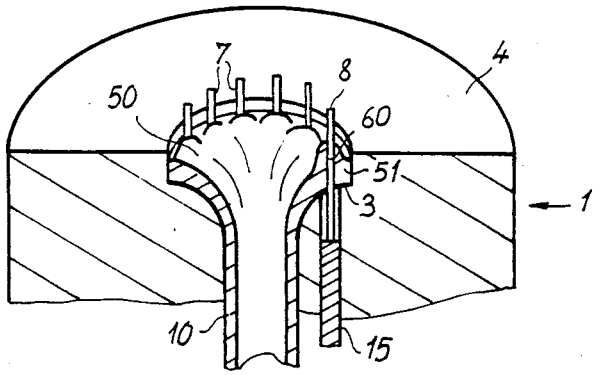
FIG. 4 is a partial cutaway, in perspective, showing the bottom mold containing a preformed stem obtained by the method of the invention.

FIG. 4 shows the bottom mold 1 containing a preformed stem 50 obtained after the pressing operation described above. The metallic conductors 7 are enclosed in the glass and constitute metallic bushings 60, while the upper ends 8 of the metallic conductor 7 are intended to be placed inside the vacuum tube (not shown).

The preformed stems 50 have a conventional shape which can be compared to that of a preformed stem obtained by a prior art method. However, it must be noted that, at this stage of manufacture, the preformed stems 50 may have a defect lying in the fact that the two glass pieces 9, 10, shown in FIGS. 2 and 3, may be imperfectly bonded to each other. For, with the method of the invention and as described above, since the bottom part 14 of the first glass piece 9 is not directly heated, it is taken to a temperature equal to or greater than the softening temperature—which, however, is lower than the working temperature at which glass is really self-bonded. The result of this may be that, chiefly in the lower zone 51 of the preformed stem 50, located near the flared outlet 3 and formed by the joining of the glass that comes firstly from the second glass piece 10, and secondly from the glass of the bottom part 14 of the first glass piece 9, the bonding between the glass of the two pieces 9, 10 is not perfect.

However, this defect can be easily remedied by reheating the preformed stems 50 so that they are all taken to the working temperature—for example, after having been removed from the bottom mold 1. In any case, the re-heating of the preformed stems 50 comes within the scope of a conventional sequence of the method in order to give the preformed stem 50 its final shape of a stem.

Thus, while the method of the invention yields a minor disadvantage, it gives, by contrast, a very major advantage which lies in a considerable improvement of the glass-metal bond. For, if the softening temperature attained by the bottom part 14 of the first glass piece 9 does not favor the self-bonding of glass. The softening temperature is nonetheless sufficient for the glass to be marked by the metallic conductor 7 so that it is entirely embedded also with glass from the second glass piece 10 and so that the formation of metal oxide on the entire embedded surface of the metallic conductors 7 is stopped. The result of this is to obtain a metal oxide layer (not shown) of a homogeneous thickess which provides for its complete diffusion in glass and for the making of a high-quality glass-metal bond.

What is claimed is:

1. A method for the manufacture of vacuum tube stems, said method comprising the steps of:

(a) loading a bottom mold having an upper face with at least one metallic conductor, a first glass piece placed externally of and surrounding the at least one metallic conductor and extending above the upper face of the bottom mold, and a second glass piece placed internally of the first glass piece and so that the at least one metallic conductor is located between the first and second glass pieces;

(b) heating the portion of the first glass piece that extends above the upper face of the bottom molds; and (c) pressing the first and second glass pieces against each other as soon as the upper portion of the first glass piece reaches the working temperature of the first glass piece, thereby preventing the formation of a crumbly oxide surface capable of breaking under the effect of mechanical or thermal stresses on the part of the at least one metallic conductor located between the first and second glass pieces.

2. A method as recited in claim 1 and further comprising the step of heating the second glass piece so that it has reached or exceeded the softening temperature of the second glass piece when the upper part of the first glass piece reaches its working temperature.

3. A method as recited in claim 1, wherein the at least one metallic conductor and the first and second glass pieces are heated without changing their relative positions with respect to the bottom mold.

4. A method as recited in claim 1 and comprising the further steps of:

(a) removing the product obtained in step (c) of claim 1 from the bottom mold and then (b) reheating the product to raise its temperature to the working temperature of the glass.

5. A method as recited in claim 1 wherein the upper portion of the first glass piece is heated by a burner.

6. A method as recited in claim 1 wherein the surface of the at least one metallic conductor is made of copper.

7. A method as recited in claim 1 wherein:

(a) the first glass piece is a hollow cylinder prior to its heating and pressing;

(b) the second glass piece is a hollow cylinder prior to its heating and pressing;

(c) the first and second glass pieces are coaxial prior to their heating and pressing; and (d) a plurality of metallic conductors are equiangularly spaced around the axis of the first and second glass pieces prior to their heating and pressing.

8. A method as recited in claim 1 wherein the upper end of the second glass piece is recessed beneath the upper end of the first glass piece.

9. A vacuum tube stem manufactured by the method of claim 1.

* * * * *